US005857591A

United States Patent [19]

Bachand

[11] Patent Number: 5,857,591

[45] Date of Patent: Jan. 12, 1999

[54] SIMULTANEOUS PUMP DISPENSER

[75] Inventor: George M. Bachand, Plantsville, Conn.

[73] Assignee: Owens-Illinois Closure Inc., Toledo, Ohio

[21] Appl. No.: 907,986

[22] Filed: Aug. 11, 1997

Related U.S. Application Data

[63] Continuation of Ser. No. 524,932, Sep. 8, 1995, Pat. No. 5,752,626.

[51] Int. Cl.[6] ..... B67D 5/52

[52] U.S. Cl. ..... 222/1; 222/136; 222/145.3; 222/383.1; 239/304; 239/306; 239/333

[58] Field of Search ..... 222/1, 136, 145.1, 222/145.3, 145.5, 383.1; 239/304, 306, 333

[56] References Cited

U.S. PATENT DOCUMENTS

| | | | |
|---|---|---|---|
| 3,269,389 | 8/1966 | Meurer et al. . | |
| 3,760,986 | 9/1973 | Castner et al. | 222/137 |
| 4,355,739 | 10/1982 | Vierkotter | 222/134 |
| 4,826,048 | 5/1989 | Skorka et al. | 222/137 |
| 4,902,281 | 2/1990 | Avoy | 604/191 |
| 5,009,342 | 4/1991 | Lawrence et al. | 222/136 |
| 5,152,431 | 10/1992 | Gardner et al. | 222/136 |
| 5,169,029 | 12/1992 | Behar et al. | 222/1 |
| 5,398,846 | 3/1995 | Corba et al. | 222/1 |
| 5,433,350 | 7/1995 | Graubart | 222/136 |
| 5,535,950 | 7/1996 | Barriac et al. | 239/304 |
| 5,562,250 | 10/1996 | O'Neill | 239/304 |
| 5,609,299 | 3/1997 | Foster et al. | 239/304 |

FOREIGN PATENT DOCUMENTS 1104531 7/1981 Canada .

*Primary Examiner*—Joseph A. Kaufman

[57] ABSTRACT

Simultaneous pump dispenser of the trigger-sprayer type has a single container with separate liquid compartments. Side-by-side main cylinders in the dispenser body have vent cylinders there-adjacent. Pistons in all cylinders are worked together by a piston/nozzle assembly separately to pump the liquids and vent the containers. A manifold in the top of the container connects supply tubes and vents in the compartments to the risers and vent passageways for the respective main and vent cylinders. The discharge may be separate spray orifices, a single spray orifice combining the liquids or a single foaming orifice.

2 Claims, 10 Drawing Sheets

SIMULTANEOUS PUMP DISPENSER

This is a Continuation of application Ser. No. 08/524,932 filed Aug. 8, 1995, now U.S. Pat. No. 5,752,626.

BACKGROUND OF THE INVENTION

This invention relates to a pump dispenser for simultaneous dispensing of two separate liquids. More specifically, this invention is concerned with a hand-held pump dispenser of the trigger-sprayer type for dispensing of two separate liquids particularly where it is desired or necessary to keep the liquids separate until they reach the surface onto which they are applied.

There has been, and still is, a need for dispensing two liquids which are to be kept separate in storage and in the dispensing operation. This may be where the two liquids will react. An example, recognized in the art, might be a cleaning system in which an alkaline material and an acid material are brought together on a surface to produce an efflorescing action to clean the surface and dissolve the soil on it. These reactants cannot be packaged together: they would promptly react in the bottle and their great advantage of interaction and reaction on the surface would be lost.

An example of a dispensing bottle for simultaneous pump dispensing of such liquids is disclosed in the U.S. Pat. No. 3,760,986 which issued Sep. 25, 1973 to Castner et al. In this device there is a partitioned container with two separate pumps mounted thereon having dip tubes extending into the respective compartments. The liquids are pumped separately and are emitted as sprays separately from the dispensing head on the device.

Another need for simultaneous pump dispensing is in the biological fluid field wherein, for example, blood fluids such as fibrinogen and thrombin may be stored and dispensed to combine only when sprayed onto the tissue whereon they produce a polymer having great potential benefit, both as a hemostatic agent and a tissue adhesive. An example of such a dual pump dispenser is disclosed in U.S. Pat. No. 4,902, 281 which issued Feb. 20, 1990 to D. F. Avoy.

Dual pump dispensers also find use in pharmaceutical and cosmetic media wherein two reactants can be brought together and mixed just prior or during use in order to maintain a reaction time, providing particularly fresh and, therefore, effective product. As with Avoy, above, the supply container may be in the form of two separate bottles which may be selectively replaced and renewed, a device including pump means for each container and a "handle" joining the pumps and from which the two separate liquids may be separately sprayed. Such an arrangement is disclosed in Skorka et al U.S. Pat. No. 4,826,048, issued May 2, 1989.

Of course, compartmented containers and separate valves and sprayers have been employed in the aerosol trade for years, an example being disclosed in the U.S. Pat. No. 2,941,696 to R. E. Homm, issued Jun. 21, 1960.

Molded compartmented containers for dual dispensers have been disclosed in the art, aside from the Castner et al disclosure above. An example is in the twin compartment squeeze bottle disclosed in the Green U.S. Pat. No. 4,984, 715, issued Jan. 15, 1991. In this arrangement the two containers have adjacent confronting vertical walls, joined by a central vertical web. The walls are non-diverging to "cooperate with each other . . . to support the bottle in a stable manner".

The old U.S. Pat. No. 3,347,420 to R. J. Donoghue, issued Oct. 17, 1967 includes separate molded compartments having confronting vertical walls joined by a central web. Also, the walls do diverge. The outlets at the top of the two compartments are formed in segments of cylinders producing in toto a single threaded cylinder finish adapted to receive a screw cap.

In the past, pump dispensers have been concerned with the venting of the head space as the liquid is used. Such venting avoids the build-up of a negative pressure which could stop the dispenser from functioning properly In order to avoid leakage, the vent passage has frequently been provided with a valve operating in tandem with the pump. An example is disclosed in the Dennis U.S. Pat. No. 4,958, 754, issued Sep. 25, 1990, wherein the vent valve comprises a separate valving cylinder receiving a valving piston reciprocating in tandem with the main pump piston. The valving piston, when pulled inwardly, provides clearance between the cylinder wall to permit venting. Such an arrangement was also disclosed in the Japanese patent 52-11686 of Mar. 15, 1977.

It has also been common in the past to "dress up" the otherwise functional appearance of pump dispensers, and this has frequently been done in the form of a snap-on shroud. Examples of such arrangements are found in the U.S. patents:

U.S. Pat. No. 3,820,721 Hellenkamp Jun. 28, 1974

U.S. Pat. No. 4,191,313 Blake et al Mar. 4, 1980

U.S. Pat. No. 4,257,539 Cary et al Mar. 24, 1981

British Publication application 2,244,522 Dec. 4, 1991

SUMMARY OF THE INVENTION

The present simultaneous pump dispenser embodies improvements over such devices in the art. The invention is a trigger sprayer for spraying separately two liquids comprising support means formed with first and second side-by-side main cylinders having open ends directed forwardly and first and second side-by-side vent cylinders respectively adjacent the first and second main cylinders and having open ends also directed forwardly. The vent cylinders have on their inside surfaces longitudinal piston-bypass passages in zones spaced back from their open ends respectively.

The invention also includes an integral piston/discharge assembly comprising a pair of main pistons operable in the main cylinders respectively, the pistons each having a forward tubular stem communicating with the working face of its piston. A discharge orifice is formed on the forward end of each stem and outlet check valve means intermediate the front ends of the stem and the discharge orifice. The stems are each formed intermediate its ends with a vent piston arm carrying a rearwardly directed vent piston operatively engaged in the respective vent cylinder. Spring means urge the assembly away from the main cylinders.

The invention further includes a pair of tubular intake risers in the support means and including inlet check valve means connected to the rear ends of the first and second main cylinders respectively. Vent passages in the support means connect the rear ends of the first and second vent cylinders respectively, and a trigger lever means pivoted to the support means is connected to the piston/discharge assembly for pulling the piston/discharge assembly back toward the main cylinders to effect the pumping.

A pair of supply compartments completes the assembly and the riser of the first main cylinder and the vent passage of the first vent cylinder are connected to one compartment and the riser of the second main cylinder and the vent passage of the second vent cylinder are connected to the other compartment. Connections are made through a manifold at the top of the compartments.

The invention further contemplates a container for the pump assembly comprising a pair of compartments joined at opposed adjacent walls by a central vertical web and having the walls diverging away from each other outward of the central web, one of the walls on one side of the web having a wedge-shaped projection at the level of the finish of the container and directed toward the opposing wall on the same side of the web to give the finish stability when the cap is applied.

BRIEF DESCRIPTION OF THE DRAWINGS

Other objects and features of the invention will be apparent to those skilled in the art from the following specification, including claims, and from the drawings appended hereto. In the drawings:

DESCRIPTION OF THE PREFERRED EMBODIMENT

Figure 1:
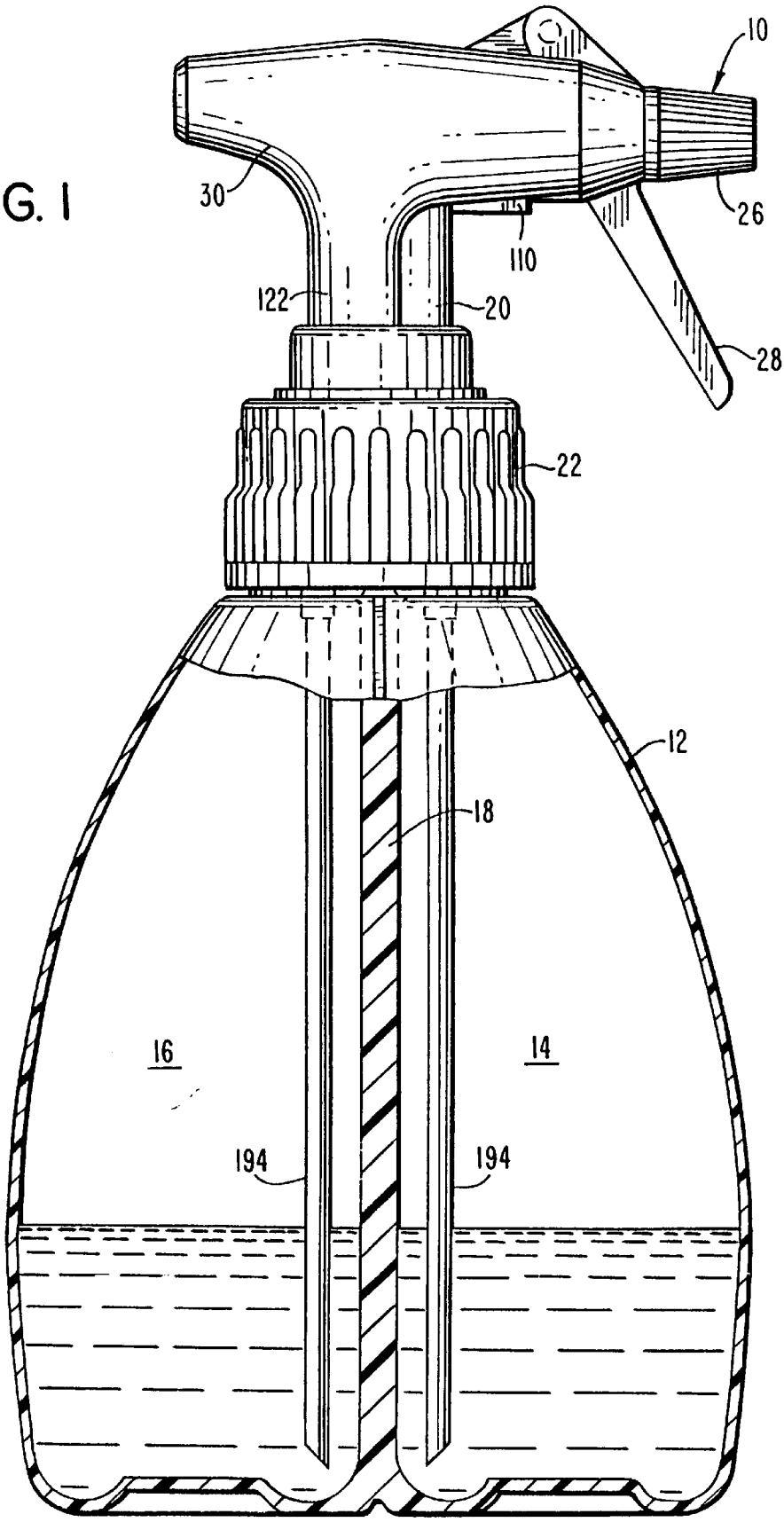
FIG. 1 is a perspective view, partly in section of a trigger sprayer dispenser embodying the invention.
Figure 2:
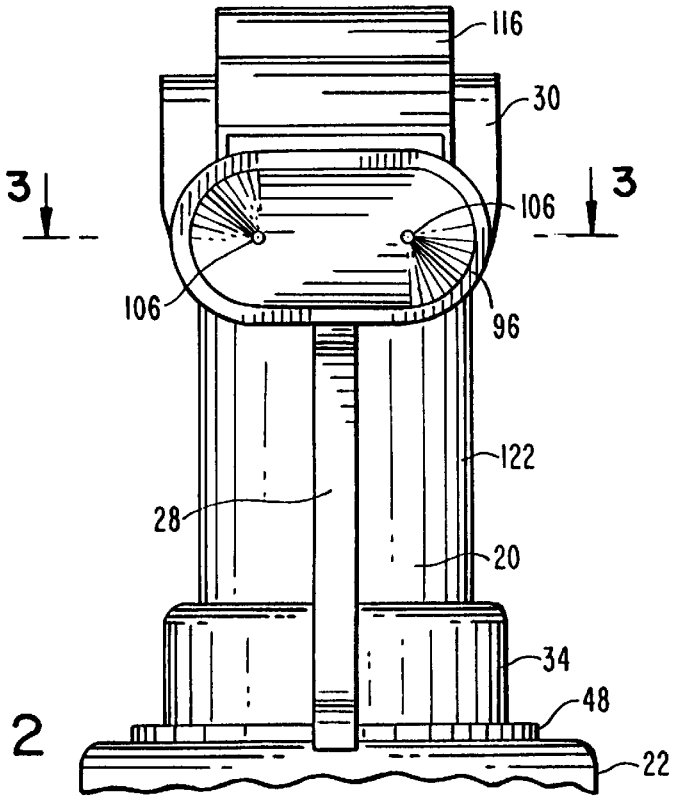
FIG. 2 is an enlarged fragmentary front elevation.
Figure 4:
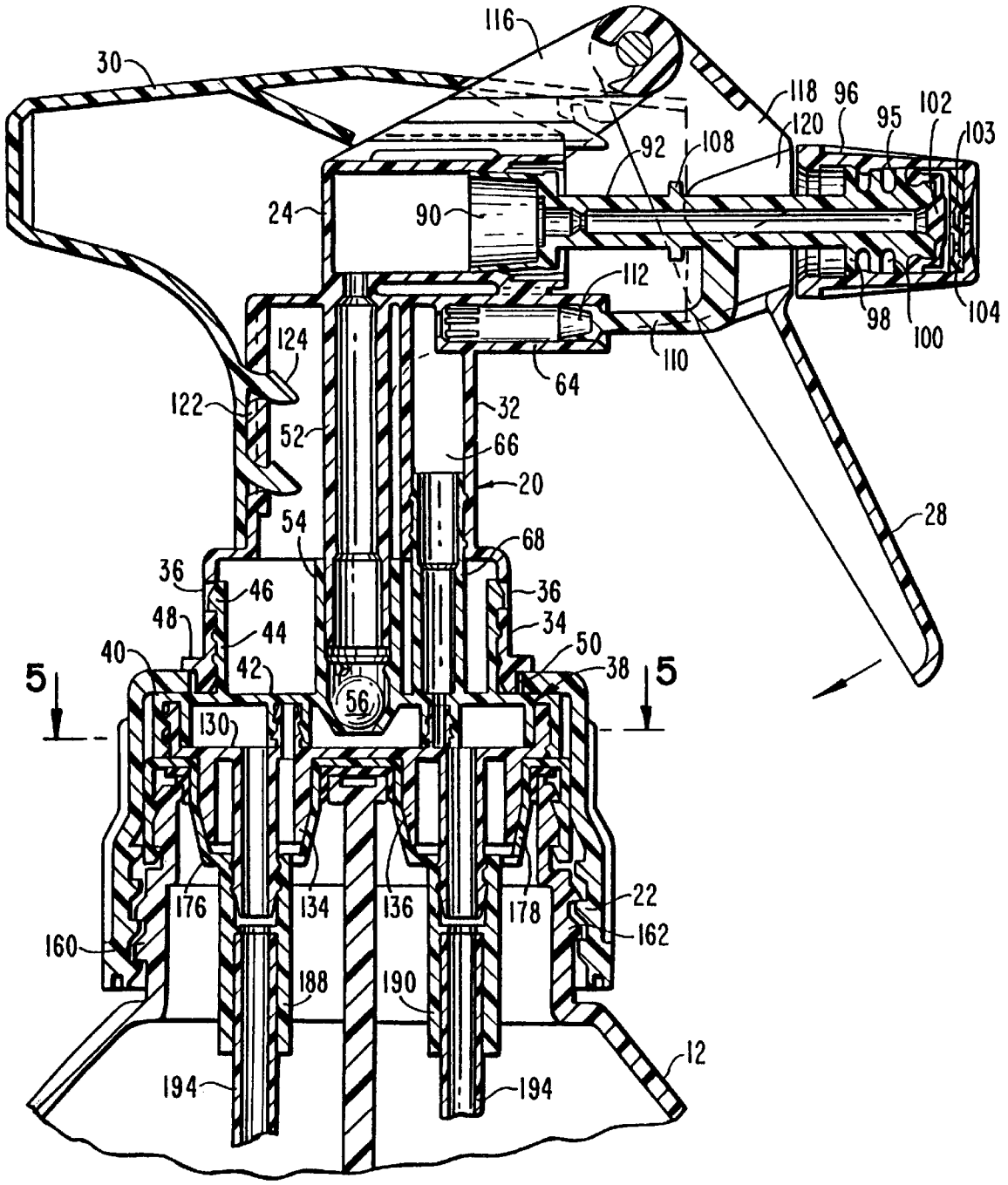
FIG. 4 is a sectional view taken on the line 4—4 of FIG. 3 with respect to the upper portion of FIG. 4 and the line 4—4 of FIG. 5 with respect to the lower portion of FIG. 4 and showing the dispenser with the nozzle/piston assembly extended, away from the cylinder.

A simultaneous pump dispenser embodying the invention is designated 10 in FIG. 1. It comprises a container 12 defined by two separate compartments 14 and 16 joined by a unitary molded vertical web 18. The dispenser further includes a support 20 secured releasably to the top of the container 12 by a screw cap 22 and formed with pumping chambers 24 (FIG. 4). A piston/nozzle assembly 26 operable in the cylinders and driveable by an operating trigger 28 pivoted to the support 20 to effect the pumping. A shroud 30 covers the support to streamline the assembly.

Referring to FIG. 4, the support 20 includes an upper tubular element 32 having an enlarged hollow base 34. The hollow base is apertured as at 36 on opposite sides. The support also includes a connector manifold 38 flat and cylindrical in cross-section. The manifold comprises in turn an upper part 40 which has a horizontal wall 42 and is formed with upward snap fingers 44 having barbs 46 on their upper ends. The base 34 is formed with an outward peripheral flange 48 and the cap 22 is formed with a central aperture 50.

Thus, in assembly, the manifold 38 may be maneuvered up into the inside of the cap so that the wall 42 of part 40 butts against the top of the annular top wall of the cap 22, the fingers 44 extending through the opening 50. The fingers formed with appropriate lead-ins flex to receive the base 34 and, when properly aligned with the base and closed home, the barbs 46 snap into opening 36 to hold the support 20 onto the cap 22 as the partial top wall of the cap is held compressively between the flange 48 and the upper part 40.

Figure 3:
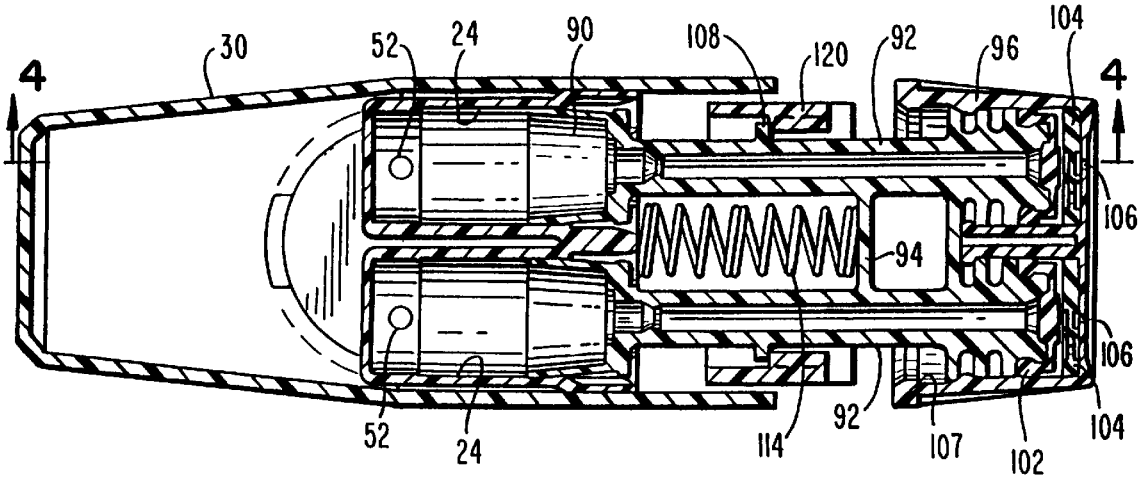
FIG. 3 is a sectional view taken on the line 3—3 of FIG. 2.

The top of the support 20 is formed, as stated, with cylinders 24 (FIG. 3), open ends forward. The cylinders, as shown, are side-by-side and adjacent their closed ends separate riser tubes 52 connect and extend vertically downward. These telescope respectively into upward fittings 54 integral with the upper part 40. The fittings each contain an upstream check ball 56 which normally seats on an inclined annular seat 58 at the bottom of the fitting and open to the inside of the manifold 38. Inward nibs 60 in the fitting limit the upward travel of the ball 56 during aspiration.

Figure 4A:
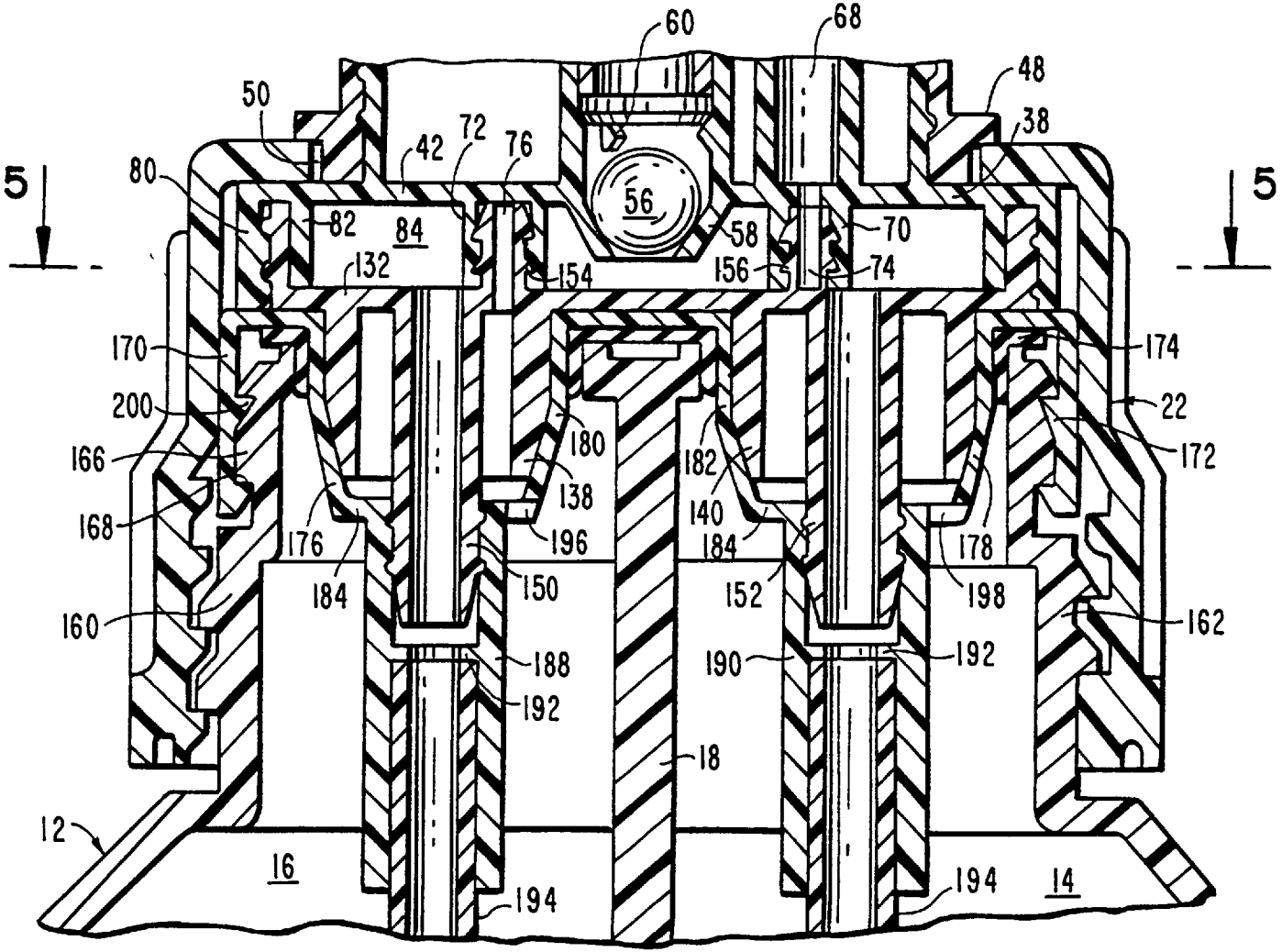
FIG. 4*a* is a greatly enlarged portion of FIG. 4.
Figure 5:
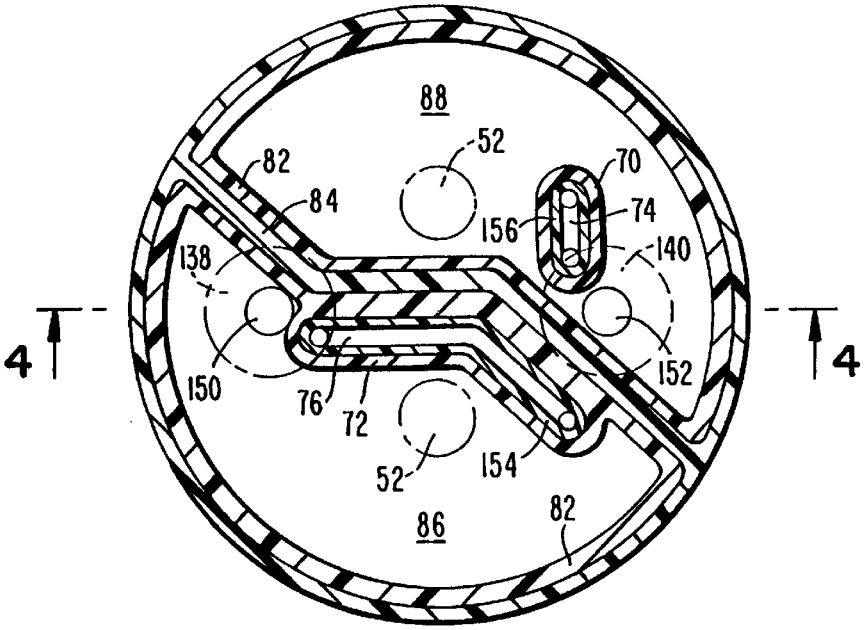
FIG. 5 is a slightly enlarged sectional view taken on the line 5—5 of FIG. 4.

Positioned under the respective cylinders 24 are the vent valve cylinders 64, open ends also forward. The rear end of the vent cylinders is open and communicate respectively with downward passages 66 in the support 20. These passages receive respectively upward spuds 68 integral with and communicating with the upper part 40 of the manifold. The spuds terminate on the other side of the top wall 42 of the manifold with downward boundary walls 70 and 72 (FIG. 4*a*) which help define independent passageways 74 and 76 in the manifold 38 for reasons which will appear. The upper part 40 of the manifold further comprises a unitary downward outside wall 80 and an inside vertical wall 82. A zig-zag partition wall 84 bisects the interior of the manifold into two internal chambers 86 and 88 and is molded unitary with the top part (FIG.5).

Turning now to the piston/nozzle assembly 26 (FIG. 3), it is shown as a simple frame-like structure, but may, in fact, be made of plural interfitting components (not shown). At any rate, it comprises a pair of main pistons 90 having forward tubular stems 92 connected thereinto. The stems are parallel and joined by a unitary bridge 94 (FIG. 3) The front end of the stems is formed unitarily with a more or less conventional tubular nozzle fitting 95 with central end openings, the two fittings being joined together at their inner ends. The fittings are surrounded by a tandem nozzle cap 96 with a spacer 98 which may be pushed in to shut off or pulled out to spray so that its detents 98 engage the inner or outer circumferential groove 100 in the head, respectively, as is conventional.

Also conventional, the fittings are each covered by a resilient cup-like downstream check 102 which, in the inner or shut position of the cap, plugs the end opening of the nozzle fitting. In the spray setting the check 102 will flex outward to permit passage of liquid into a swirl chambers 103 in a spacer 104 secured against the front wall of the cap.

This is as described in the McKinney U.S. Pat. No. 4,227,650 issued Oct. 14, 1980 to my assignee. The emission from each swirl chamber through each orifice 106 is a spray. The stop shoulder 107 on the cap 96 prevents one from pulling the cap off the fitting 95 altogether.

Figure 10:
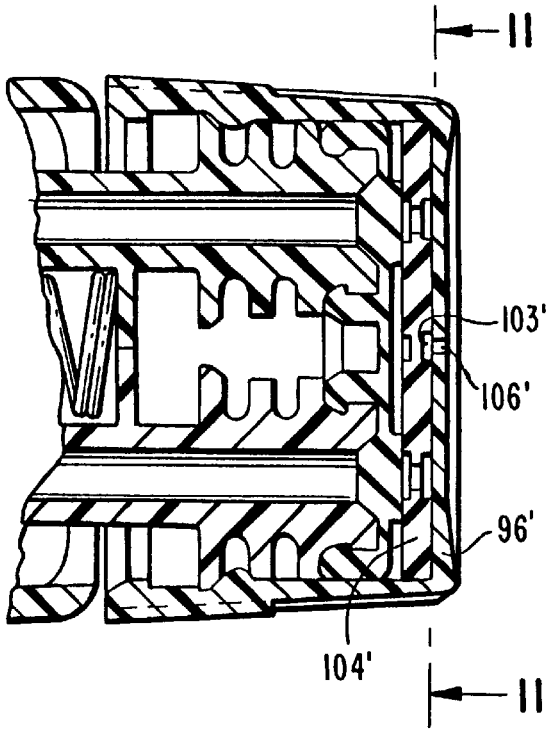
FIG. 10 is an enlarged sectional view, similar to a fragment of FIG. 4, of a modified nozzle.
Figure 11:
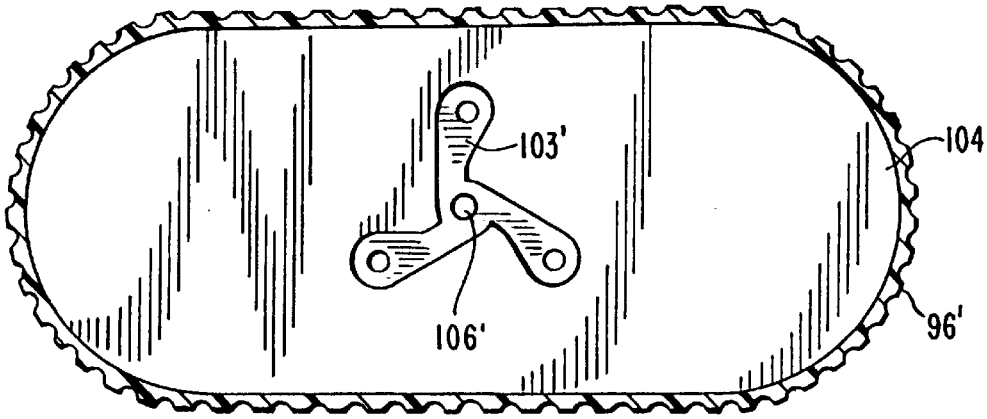
FIG. 11 is a sectional view taken on the line 11—11 of FIG. 10.

In certain applications, the two liquids may be mixed in the nozzle to discharge as a single spray. Thus, in a modified version (FIGS. 10,11) the nozzle cap 96' combined with its spacer 104' may be in the form of an internal mixing chamber with a single spray outlet (FIG. 11). More specifically, the spacer 104' is formed with a central swirl chamber 103' (FIG. 11) to which the nozzle head end openings both communicate in the spray setting The liquids both enter the swirl chamber and leave it to discharge out the single central orifice 106'.

Figure 12:
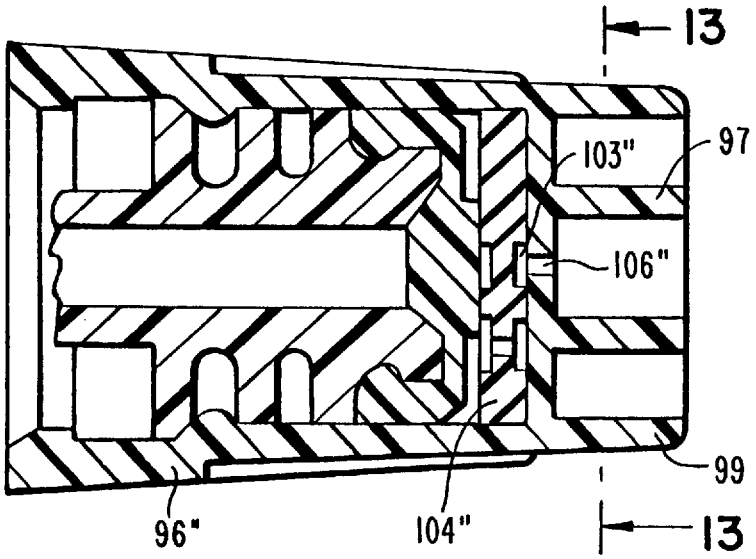
FIG. 12 is an enlarged sectional view of a further modified nozzle.
Figure 13:
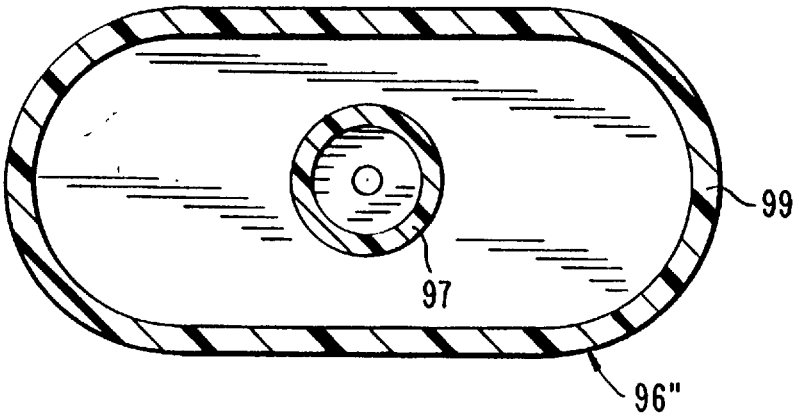
FIG. 13 is a sectional view taken on the line 13—13 of FIG. 12.

Alternatively, in still another modification, the cap 96" may be in the form of a foam generating outlet (FIGS. 12,13). In this version the cap 96" is similar to cap 96' in that it provides a single orifice 106" for the combined emission, the front of the cap differing in that the orifice is surrounded by an annular foaming wall 97. Thus, when certain liquids in compartments 14, 16 are pumped up and internally mixed in the same arrangement as described in connection with FIGS. 10 and 11 the cone-shaped spray engages the foaming wall 97 and immediately foams and discharges therefrom as a foam. The oval periphery of the cap 96" is formed with a forward wall 99 which guards the foaming wall 97 and gives the unit a more aesthetic-ally pleasing appearance.

As shown, the tubular stems 92 of the piston/nozzle assembly are formed intermediate their ends with outward flanges 108. They are also formed forwardly of the flanges with downward and rearward arms 110 terminating in resilient pistons 112 fitting into the respective valve cylinders 64. As noted, the interior of the valve cylinders may be longitudinally ribbed back from their opening, or enlarged, so that the valve pistons 112 will, when positioned rearwardly in its cylinder, permit venting as described in the Dennis patent, above.

Figure 6:
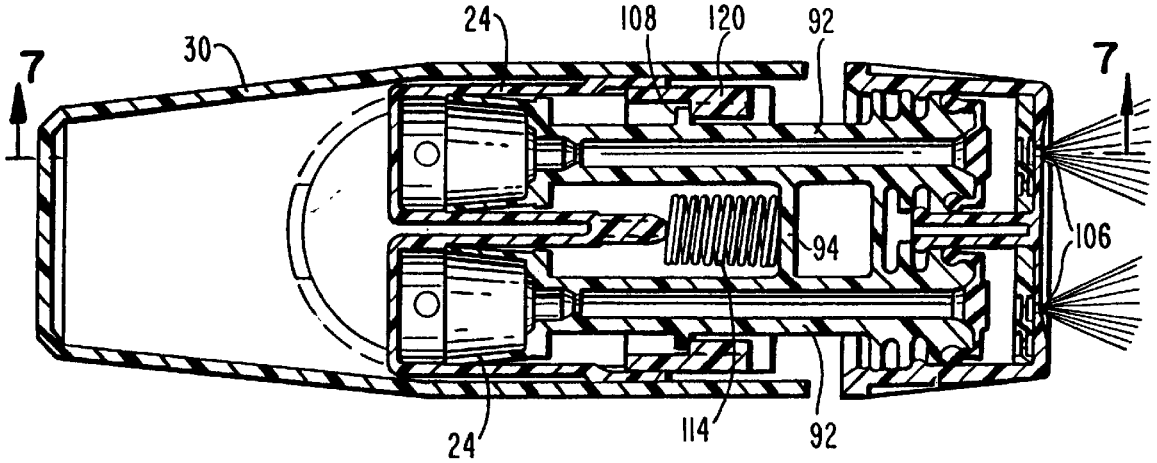
FIG. 6 is a sectional view similar to FIG. 3 but showing the piston/nozzle assembly pulled back.
Figure 7:
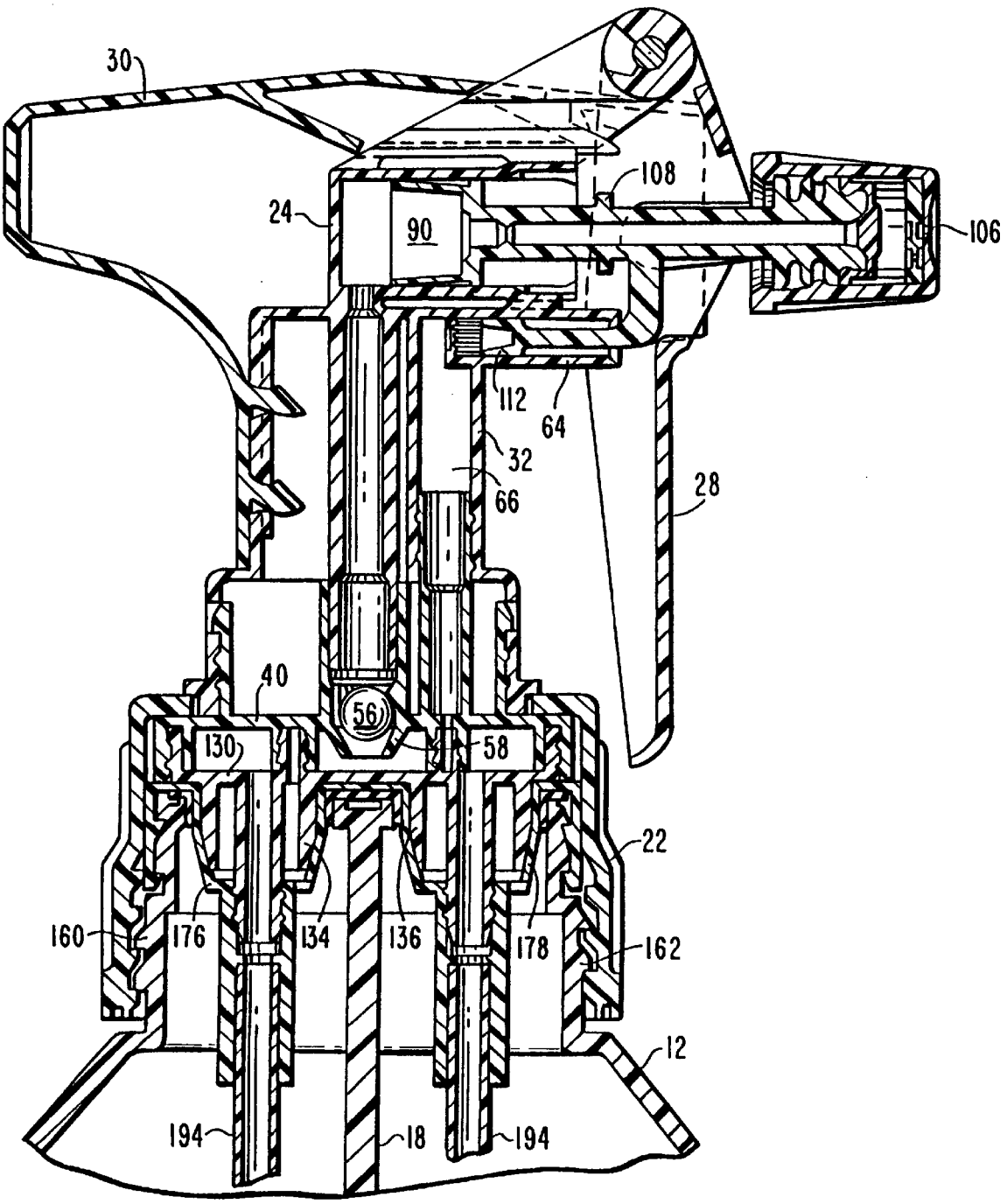
FIG. 7 is a sectional view similar to FIG. 3 but showing the piston/nozzle assembly pulled back.

A spring 114 (FIGS. 3, 6) is in compression between the bridge 94 and a platform between the cylinders 24, urging the piston/nozzle assembly outward.

Extending upward from the two cylinders 24 is the pivot arm 116 having a horizontal aperture in its upper end. To this is pinned the upper end of the trigger 28. The trigger is formed with a central opening 118 receiving the stems 92 (FIG. 4). It is also formed with an inward pair of fingers 120 which work against the flanges 108 driving the piston/nozzle assembly leftward (FIG. 4) when the trigger 28 is pulled back.

Completing the upper portion of the dispenser, a shroud 30 is formed of an aesthetic shape including a downward cowling 122. The cowling 122 is formed with inward arrowheads 124 (FIG. 4) to snap into appropriate apertures in the support 20. Appropriate cut-outs are made in the shroud 30 for the pivot arm 116 so that the overall impression is as smoothly stream-lined as possible.

The manifold 36 on the bottom of the support 20 also includes the lower part 130. This part includes a bottom wall 132 which is unitary with and extends downward therefrom interfitting connectors 134, 136. These comprise respectively the outer annular walls 138 and 140 (FIG. 4*a*). Coaxial and central of the annular walls 138, 140 and comprising parts of the interfitting connectors are the longer central supply nipples 150, 152. The supply nipples at their upper end connect to the chambers 86 and 88 respectively inside the manifold 38 so that they communicate through the respective fittings 54 and risers 52 (shown dotted in FIG. 5) to the cylinders 24. The lower ends of the supply nipples have outward ribs as shown to seal the supply connections.

The annular spaces between the annular walls 138 and 140 and the respective supply nipples are connected through the bottom wall 132 of the manifold to the passageways 74 and 76. As shown in FIG. 4*a*, boundary walls 154 and 156 upward from the bottom wall 132 telescope snugly inside the downward boundary walls 70 and 72.

Figure 8:
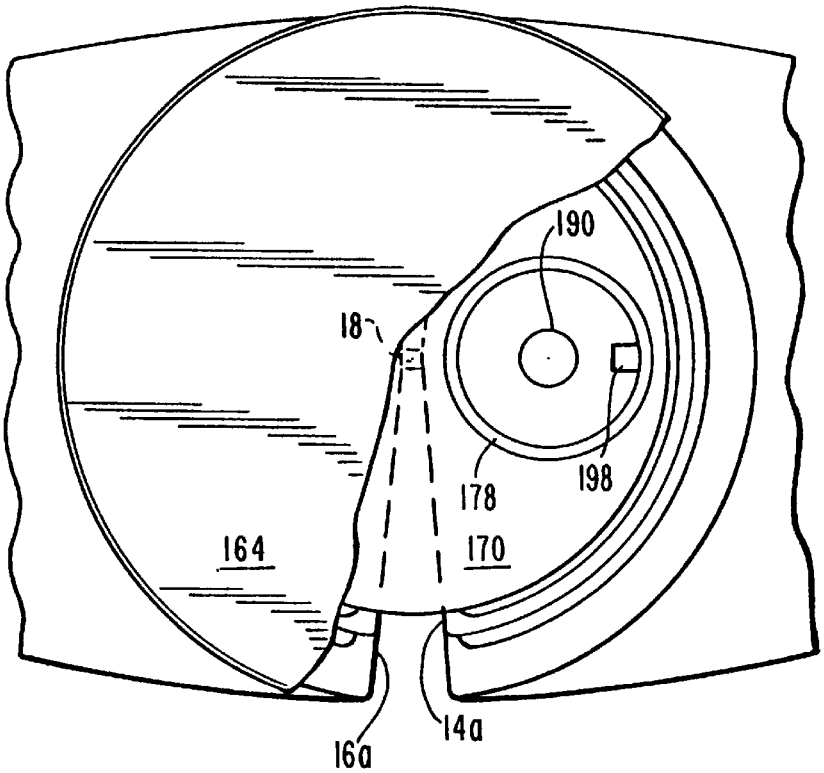
FIG. 8 is a fragmentary top view with the cover and cap partly broken away of a capped container adapted for use with the dispenser of the invention.
Figure 9:
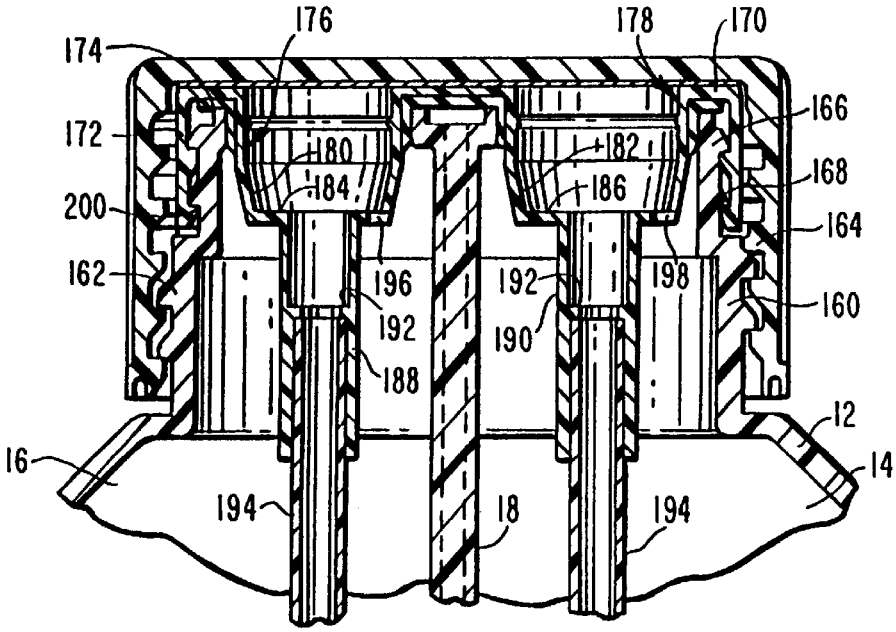
FIG. 9 is a fragmentary vertical sectional view of the upper end of the container of FIG. 8.

Turning now to the container itself, FIGS. 8 and 9 detail the upper end of a container as may be supplied in the "after market" and suitable for installation onto the simultaneous pump dispenser head of the invention. The container of these FIGS. is the same as the container of FIGS. 1–7, except for the solid cap, and the same reference numbers are applied in FIGS. 1–7.

As described, the container 12 is unitarily molded and comprises two separate compartments 14 and 16. These compartments have confronting vertical walls 14*a* and 16*a* which diverge on opposite sides of a central vertical connecting web 18. At their upper ends the compartments are narrowed to form individual finishes 160 and 162. The finishes have the cross-section of similar a broad pie-slice-shape having the point at the central web 18. Thus, the arcuate peripheries of the two finishes form a fragmented cylinder. They are threaded as shown to receive either the container cap 164 having a solid top wall or, in later use, the apertured cap 22 securing the pump to the container.

An upper portion of the finish is reduced in diameter as at 166 and provided with outward peripheral barbs 168. As shown in FIG. 8, the two finishes are provided with a cover 170 having an arcuate periphery and a depending side wall 172. The cover has a liner 174 which engages and seals the respective finishes.

The cover is formed with depending connectors 176 and 178. Each connector has a larger upper section 180 and 182 formed with an inward shoulder 184 and 186 and a downward reduced tubular lower portion 188 and 190 which may be provided with inward stop 192, the lower end of the lower connector receiving a dip tube 194 in snug fit. At the shoulder 184 and 186 the connectors are apertured at 196, 198 to provide a vent passage. As shown, the side wall 172 of the cover is formed with detents 200 which snap over the barbs 168 on the outside of the finishes to secure it.

In assembly, after both compartments 14 and 16 are filled, the cap 164 is installed on the fragmented cylinder finish of the container 12. The container cap 164 is itself provided with a liner which assures against leaks either to the outside of the container or from one compartment to another via the open connectors.

Figure 14:
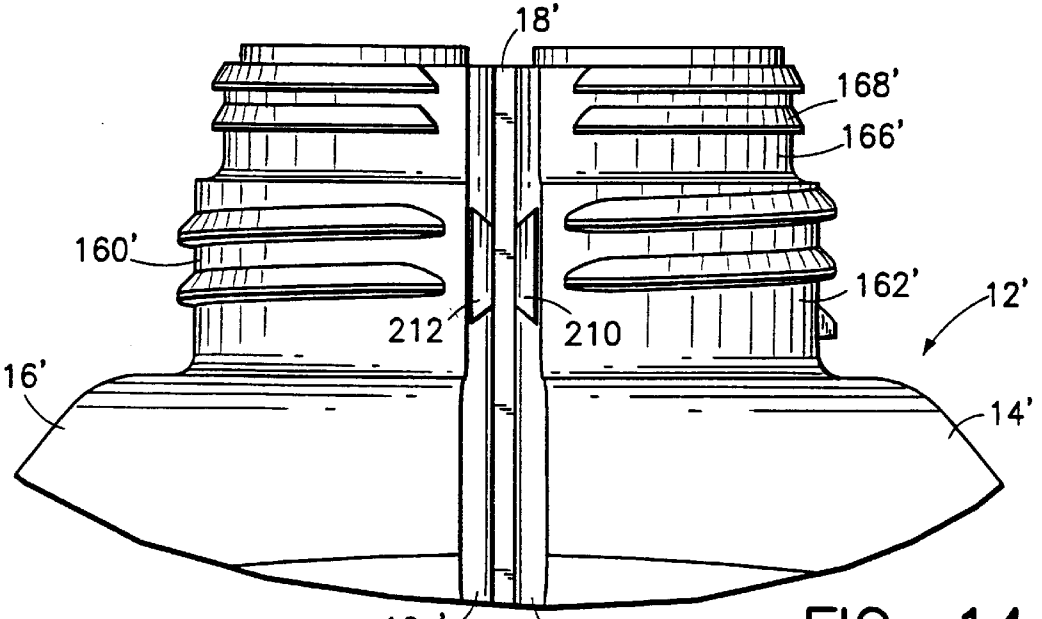
FIG. 14 is an enlarged fragmentary front elevational view of the upper end of a modified container embodying the invention.
Figure 15:
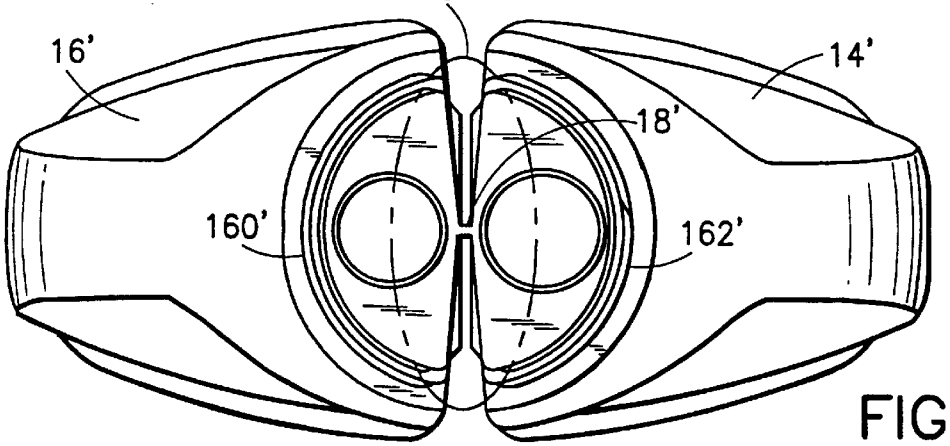
FIG. 15 is a top plan view of the container of FIG. 14.
Figure 16:
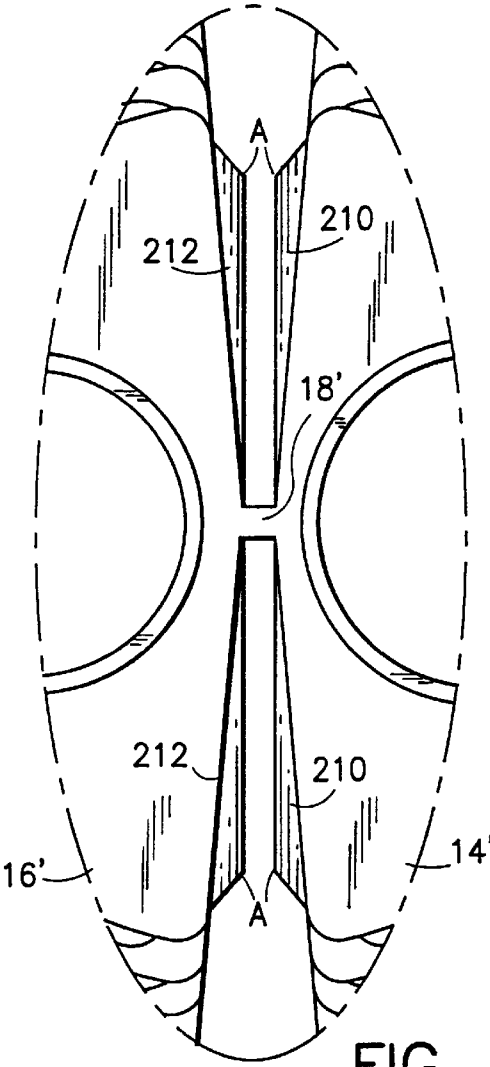
FIG. 16 is a greatly enlarged portion of FIG. 15.

FIGS. 14 through 16 disclose a modified form of container 12' comprising the compartments 14' and 16'. Each of the compartments is formed with a finish 160', 162' having threaded portions as described earlier. An upward extension from the finish 166' is reduced in diameter and has the outward annular barbs 168'. The compartments are joined centrally in their opposed walls by a vertical web 18'.

As shown in FIG. 15, the opposed diverging walls 16*a'* and 14*a'* are formed with web-shaped projections 210, 212 which are thinner adjacent the central web 18' and thicker more remote therefrom so that the opposing walls of the projections on the same side of the web 18' are substantially parallel. Preferably each of the opposed walls is formed with such projections so that pivoting about the vertical web 18' of the two containers is limited as points remote from the vertical web 18' engage each other.

The purpose of the projections on the opposed side walls, as described, is to stabilize the shape of the finish as the cap 22' (not shown) is applied. It can be imagined that as the cap is tightened, there may be a tendency for two compartments to shift slightly about the web 18' and this is thwarted as the web-shaped projections 210 and 212 contact each other at points A (FIG. 16).

The operation of this structure thus far disclosed has probably already been inferred by those skilled in the art. It may be detailed as follows: The assembly shown in FIGS. 1 through 7 is as the product might be bought in a retail store, both compartments filled and yet unused. As shown in FIG. 4, the interconnectors 134, 136 sealingly mate with the connectors 176, 178 so that the dip tubes 194 communicate up through the supply nipples 150, 152 into the respective manifold chambers 86 and 88, up the respective fittings/nozzles 54, 52 into the respective cylinders 24.

Assuming a pre-prime, as described, a rearward pull on the trigger 28 will drive the pistons 90 back into the cylinders 24, reducing their volumes and sending the liquids separately through the respective stems 92 past the outlet check 102 into the swirl chambers 104 and as spray, for instance, out the orifices 106. The discharge from the nozzles may also be separate squirts or foam worms if desired or necessary.

Upon release of the trigger 28, the spring 114 (FIG. 3) drives the piston/nozzle assembly away from the cylinders 24 reducing the volume of the cylinders to raise inlet check balls 26 off their seats and draw liquid up to the main cylinders through the respective manifold chambers and dip tubes 154.

On a repeat pull back of the trigger 28 the cylinders 24 will be pressurized, forcing the balls 56 to seat, and drive further emissions out orifices 106.

During each pullback of the trigger 28, the vent pistons 112, which, in the position shown in FIG. 4, seal the vent lines, move back in their little cylinders 64 to a position where the pistons, being resilient, are collapsed inwardly by the ribs to open the vent passages. This permits the ambient to travel into the respective vent cylinders 64 down the vent passageways 66, 68 and into the respective passageways 74, 76 and into the annular spaces between the annular walls 136 and 138 and the supply nipples 150 and 152 and out the vent passages 196, 198 (FIG. 9) to preclude any negative build-up in the respective head spaces of the two compartments 14 and 16.

When the contents of the container of FIG. 1 are used up, a new container, FIGS. 8 and 9, may be bought, the old container unscrewed, the new one opened and installed in its place.

It will be seen that the present invention affords a practical means for isolating two liquids from each other during the pumping and spraying process so that they only meet on the surface to which they are applied. The invention provides not only effective pumping means and effective venting means which isolate the ambient passageways so that there can be no contamination of one liquid by another. This invention also contemplates means for efficiently and easily replacing used up containers.

Variations in the invention are possible. Thus, while the invention has been shown in only one embodiment, it is not so limited but is of a scope defined by the following claim language which may be broadened by an extension of the right to exclude others from making, using or selling the invention as is appropriate under the doctrine of equivalents.

What is claimed is:

1. A method of preparing to dispense two separate liquids comprising the steps of:

a. providing a pump dispenser comprising a tubular support, a pair of side-by-side cylinders secured to the upper end of the tubular support, a pair of pistons operable in the respective cylinders, a trigger movably mounted on the dispenser and adapted to drive the pistons into the respective cylinders, discharge orifice means on the dispenser, separate passage and valve means operatively connecting the cylinders and the orifice means and terminating in respective downward risers, b. providing a manifold secured to the lower end of the tubular support and having a pair of downward spaced nipples, the nipples being connected respectively to the risers and including a first threaded cap having a top wall with an opening therein, the top wall engaging the manifold and the opening rotatably receiving the tubular support, c. providing a compartmented container having a vertical partition means therein and a threaded finish, a top wall secured to the upper end of the finish and sealingly engaging the partition means, the top wall having therein downward tubular connectors on opposite sides of the partition means, the downward tubular connectors being joined to respective dip tubes extending down into the respective compartments, and a second threaded cap threadedly engaging the finish of the container having an imperforate top wall sealingly engaging the top wall of the container, d. removing the second threaded cap from the container, e. placing the manifold over the top wall of the container with the nipples sealingly engaging respectively into the downward tubular connectors on the top wall of the container, and f. rotating the first cap onto the finish of the container to secure the dispenser and manifold onto the container.

2. A method as claimed in claim 1 wherein the top wall of the container has annular connectors to spaces inside the respective compartments adjacent upper ends of the compartments and the dispenser includes vent valves operable by the trigger and connected to respective interconnectors extending downward from the manifold, and the process includes the step of sealingly connecting the interconnectors of the manifold and the annular connectors of the container prior to rotating the first cap onto the finish.

* * * * *